US010863842B2

(12) United States Patent
Ortiz

(10) Patent No.: US 10,863,842 B2
(45) Date of Patent: Dec. 15, 2020

(54) ROTARY ORGANIZER FOR BRUSHES

(71) Applicant: Jamie Ortiz, Pleasanton, CA (US)

(72) Inventor: Jamie Ortiz, Pleasanton, CA (US)

( * ) Notice: Subject to any disclaimer, the term of this patent is extended or adjusted under 35 U.S.C. 154(b) by 0 days.

(21) Appl. No.: 15/133,263

(22) Filed: Apr. 20, 2016

(65) Prior Publication Data

US 2016/0309938 A1 Oct. 27, 2016

Related U.S. Application Data

(60) Provisional application No. 62/178,933, filed on Apr. 24, 2015.

(51) Int. Cl.

| | |
|---|---|
| ***A47G 29/08*** | (2006.01) |
| ***A47K 1/09*** | (2006.01) |
| ***B43M 99/00*** | (2010.01) |

(52) U.S. Cl.

CPC ..... *A47G 29/08* (2013.01); *A47K 1/09* (2013.01); *B43M 99/00* (2013.01)

(58) Field of Classification Search

CPC ..... A47G 29/08; B05C 21/00; B43K 31/00; F16M 11/2014; B25B 11/005; F16B 47/006; Y10S 292/28; A47K 1/09; A47B 81/02; A47F 7/0021; A46B 17/02

See application file for complete search history.

(56) References Cited

U.S. PATENT DOCUMENTS 1,507,466 A * 9/1924 Collins ..... A47K 1/09 132/310
1,629,213 A * 5/1927 Hughes ..... B25H 3/02 206/209
2,533,355 A * 12/1950 Comfort ..... B44D 3/125 131/260
2,566,650 A * 9/1951 Anderson ..... B44D 3/125 211/65
3,637,172 A * 1/1972 Diesbach ..... A47B 19/002 248/460
3,731,333 A * 5/1973 Davis ..... A47L 13/51 15/257.01
4,158,413 A * 6/1979 Briggs ..... A47K 1/09 211/100
4,219,035 A * 8/1980 Deconinck ..... A47K 1/09 206/561
5,318,262 A * 6/1994 Adams ..... F16B 47/00 248/205.8
5,484,065 A * 1/1996 Davoli, Jr. ..... A47K 1/09 211/2
5,839,712 A * 11/1998 Wang ..... B43M 99/003 211/69.5

(Continued)

*Primary Examiner* — Jennifer E. Novosad
(74) *Attorney, Agent, or Firm* — Ellenoff Grossman & Schole LLP; James M. Smedley; Alex Korona

(57) ABSTRACT

A rotatable organizer for a multitude of brush types. The rotatable organizer is configured to organize hair brushes, make-up brushes, paint brushes, markers, pencils and anything of the like while allowing the user easier access due to a swiveling or rotary motion. The rotatable organizer can be rotated into a plurality of designated positions and secured in each such designated position when a locking peg engages with a groove formed in the base of the organizer. The rotatable organizer may further include a weighted element, a securing element, or a combination thereof to stabilize the rotatable organizer while it is being rotated.

13 Claims, 6 Drawing Sheets

(56) References Cited

U.S. PATENT DOCUMENTS 6,053,338 A * 4/2000 Avery ..... A46B 15/0055 211/184
6,102,203 A * 8/2000 Marro ..... A47K 1/09 206/362.1
D440,089 S * 4/2001 Lillelund ..... D6/524
6,237,880 B1 * 5/2001 McNutly ..... A47B 81/02 206/209
6,402,104 B1 * 6/2002 Smith ..... A47K 1/09 248/205.5
6,422,402 B1 * 7/2002 Hollinger ..... A47G 21/16 211/13.1
6,588,609 B1 * 7/2003 Richet ..... F16M 11/08 211/163
D499,917 S * 12/2004 Hernandez ..... D6/528
6,832,615 B2 * 12/2004 Hensel ..... A61C 15/043 132/321
D545,062 S * 6/2007 Nagoya ..... D4/113
7,246,709 B2 * 7/2007 Kim ..... A47K 1/09 211/65
7,299,922 B2 * 11/2007 Ceballos ..... A47K 1/09 206/15.2
7,628,362 B2 * 12/2009 Song ..... F16B 47/003 248/205.5
7,882,949 B1 * 2/2011 Singh ..... A47K 1/09 206/209.1
2007/0084810 A1 * 4/2007 Morris ..... A47K 1/09 211/65
2007/0267368 A1 * 11/2007 Pappas ..... A47K 1/09 211/65
2009/0014399 A1 * 1/2009 Bott ..... A47K 1/09 211/85.12
2009/0050758 A1 * 2/2009 Carnevali ..... F16B 47/00 248/205.8
2009/0200184 A1 * 8/2009 Cullen ..... A47K 1/09 206/362.2
2010/0000951 A1 * 1/2010 Morris ..... A47K 1/09 211/65
2016/0309938 A1 * 10/2016 Ortiz ..... A47G 29/08

* cited by examiner

ROTARY ORGANIZER FOR BRUSHES

CROSS REFERENCE TO RELATED APPLICATIONS

This application claims the benefit of U.S. Provisional Patent Application No. 62/178,933 Filed Apr. 24, 2015, the entire disclosure of which is incorporated herein by reference.

FIELD OF INVENTION

Embodiments of the present invention are generally directed towards an organizer for a multitude of brush types. Specifically, embodiments of the present invention are directed to an organizer configured to organize hair brushes, make-up brushes, paint brushes, markers, pencils and anything of the like while allowing the user easier access due to a swiveling or rotary motion.

BACKGROUND

The use of brushes is ubiquitous in society. From painting, to makeup, to hair, brushes are used for a vast multitude of purposes. Brushes come in all shapes, sizes, and bristle types. Given the vast variety of brushes, for any purpose, organization of such brushes can be paramount to the convenience of a particular user. Many use a simple container, like a bucket, cup or other generally cylindrical container to retain brushes until they are needed for use.

The drawbacks to using a simple cylindrical container for brush retention is that it makes it difficult to retrieve any particular brush without searching needlessly through the entirety of brushes contained in the container.

Organization of brushes is critical for optimizing efficiency and use of the brushes, but organization alone may not be enough. Even where brushes could be organized within a container, retrieval can still be made difficult by lack of the ability to effectively reach or access brushes not located at the side of a container nearest to the withdrawing user.

Therefore, there is a need in the art for an organizer for brushes that combines the ability to securely retain a plurality of brushes of varying brush types while also allowing for a swiveling or rotary motion for easy access of those brushes. These and other features and advantages of the present invention will be explained and will become obvious to one skilled in the art through review of the present application.

SUMMARY OF THE INVENTION

Accordingly, embodiments of the present invention are directed at providing an organizer for brushes that combines the ability to securely retain a plurality of brushes of varying brush types while also allowing for a swiveling or rotary motion for easy access of those brushes.

According to an embodiment of the present invention, a rotary organizer for brushes comprises: a cup element comprising a cavity formed from a walled surface, said cavity having therein a net element configured to retain a plurality of brushes thereupon; and a base element, connected to said cup element and forming a stable base upon which said cup element may rotate to a plurality of positions upon.

According to an embodiment of the present invention the base element further comprises a weighted element, configured to provide stability to the base and prevent the rotary organizer from tipping over when brushes are inserted or removed from said net element.

According to an embodiment of the present invention the base element further comprises a securing element configured to secure said base element to a surface.

According to an embodiment of the present invention the securing element is a suction cup.

According to an embodiment of the present invention the base element further comprises a lever and handle element configured to interact with said suction cup in order to allow for the release of said suction cup from said surface.

According to an embodiment of the present invention, each position of said plurality of positions is a defined position and rotation of said cup element upon said base element between said defined positions is aided by way of a plurality of grooves incorporated onto said base element upon which said cup element has a corresponding mating element to interact with such grooves.

According to an embodiment of the present invention the net element is formed on an inner wall of said cup element.

According to an embodiment of the present invention the net element comprises a plurality of brush retention grooves, each brush retention groove being configured to retain a brush therein.

According to an embodiment of the present invention the cup element and base element are connected via engagement between a center hub hole.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

According to an embodiment of the present invention, a rotary organizer for brushes is provided and allows for the organization of brushes, such as, but not limited to, hair brushes, make-up brushes, paint brushes, markers, pencils and anything of the like while allowing users easy access due to a swiveling, rotary or other motion. In a preferred embodiment of the present invention, a rotary organizer comprises three parts: (i) a cup, (ii) a base and (iii) a net.

According to an embodiment of the present invention, the cup element is configured with one or more grooves that function to separate one or more brushes and, in certain embodiments, intended to be aesthetically beautiful as well. In a preferred embodiment, the cup element is configured to accommodate brushes of varying sizes and types (e.g., big, small, various handle widths, various handle lengths, various head length and widths, various bristle types). In this preferred embodiment, accommodation for the brushes is provided for via a soft and pliable net inside the rotary organizer that is configured to catch and keep the brushes in a groove, especially while the rotary organizer is swiveling or otherwise rotating the cup element.

According to an embodiment of the present invention, the base element provides the swiveling (i.e., rotary) mechanism and stability for the cup element and the contents. In a preferred embodiment of the present invention, the base element allows the cup to swivel and lock/click into numerous designated positions corresponding to a plurality of grooves incorporated into or onto the base element. For example, a base element of a rotary organizer may comprise 4 grooves, allowing the cup element connected to the base element to rotate and click into 4 separate designated positions. In another example, a base element of a rotary organizer may comprise 7 grooves, allowing the cup element connected to the base element to rotate and click into 7 designated positions. One of ordinary skill in the art would appreciate that a base element could incorporate any number of grooves, and embodiments of the present invention are contemplated for use with any number of grooves.

Figure 1:
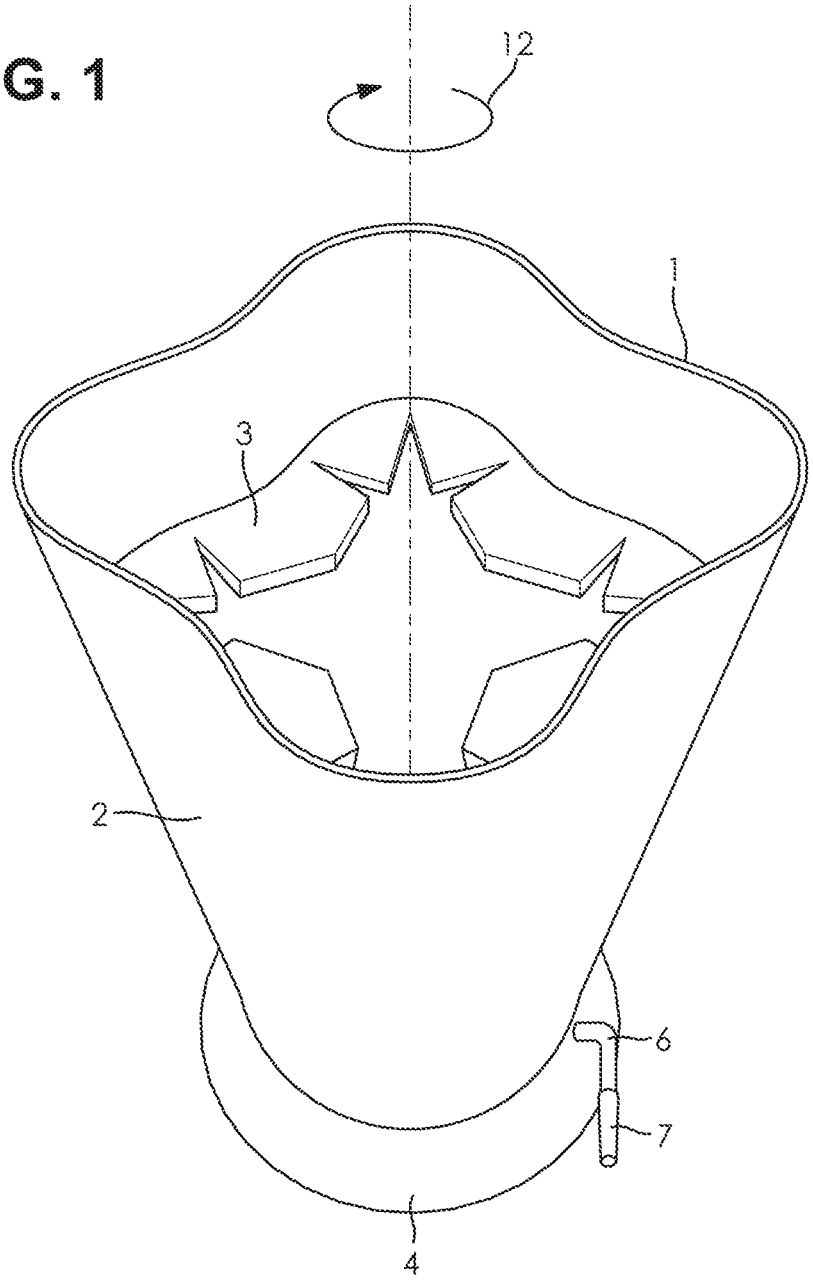
FIG. 1 is a ¾ top perspective elevation view of a rotary organizer for brushes in accordance with an embodiment of the present invention.

Turning now to FIG. 1, a ¾ top perspective elevation view illustration of an embodiment of a rotary organizer for brushes is shown. In this embodiment, the main body 1 of the rotary organizer for brushes is shown with a cup element 2 of the main body 1 with a net element 3 configured to hold a plurality of brushes. A base element 4 holds the main body 1 firmly in place. In a preferred embodiment, the cup element 2 is configured to rotate upon the base element 4, as indicated by the rotational arrow 12. Further, a lever 6 is configured to secure and release a suction cup element located at the bottom of the rotary organizer a lever handle 7 (e.g., a rubber lever handle).

Figure 2:
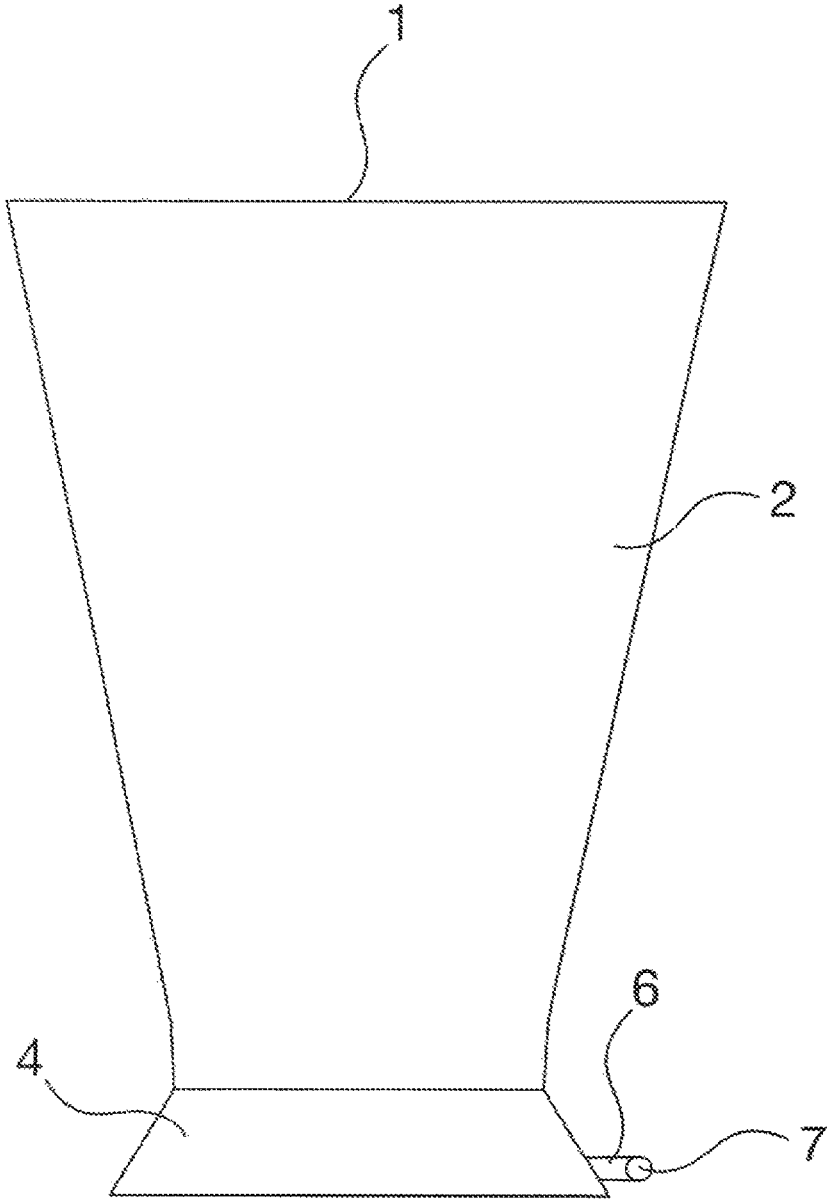
FIG. 2: is a side elevation view of a rotary organizer for brushes in accordance with an embodiment of the present invention.

Turing to FIG. 2, a side elevation view illustration of an embodiment of a rotary organizer for brushes is shown. In this embodiment the main body 1 of the rotary organizer is shown with the cup element 2 and base element 4 similar to those shown in FIG. 1 and described above. Similarly, the base element 4 holds the main body 1 firmly in place. The lever 6 secures and releases the suction cup at the bottom of the rotary organizer a lever handle 7.

Figure 3:
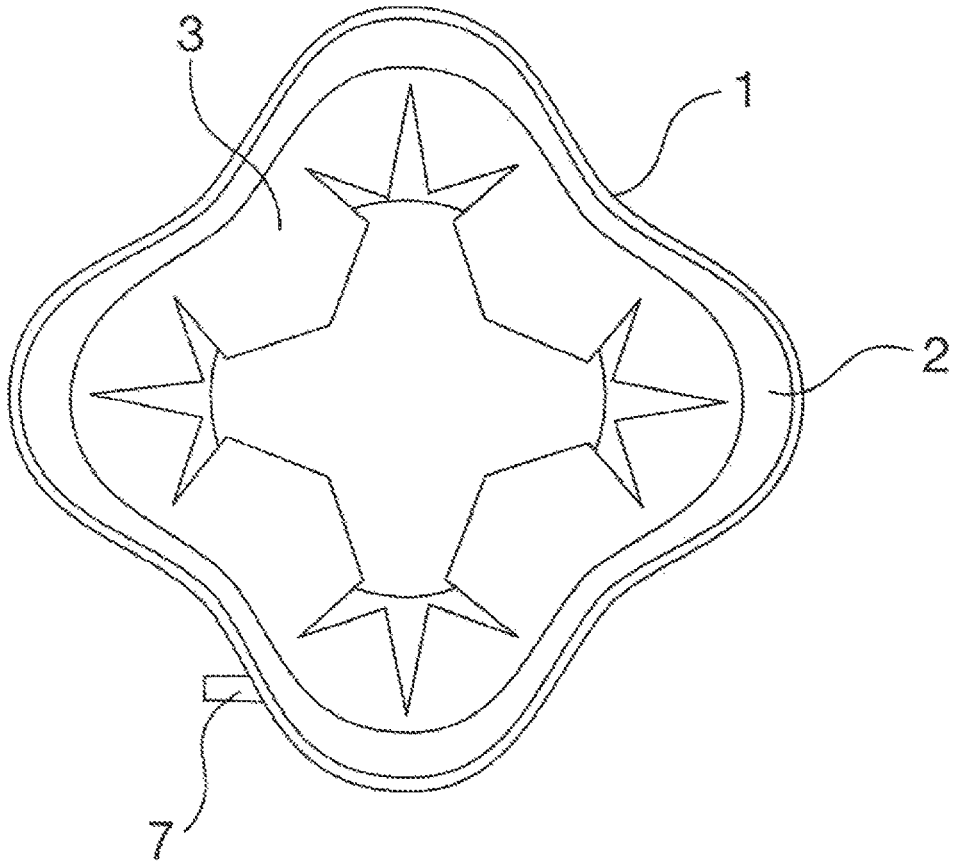
FIG. 3: is a top elevation view of a rotary organizer for brushes in accordance with an embodiment of the present invention.

Turning now to FIG. 3, a top elevation view illustration is shown. In this embodiment, the main body 1 of the rotary organizer is shown with cup element 2 of the main body 1 and the net element 3 of the main body 1. Further shown in this figure is the lever handle 7.

Figure 4:
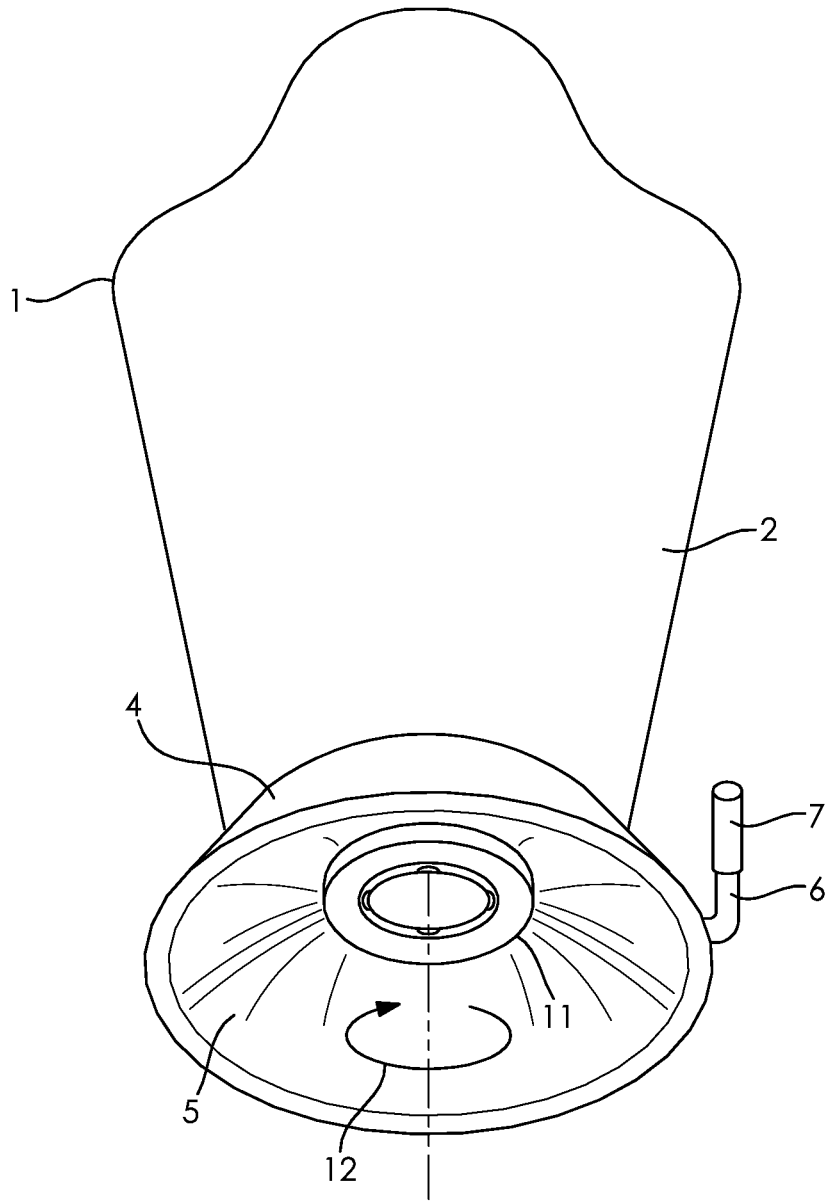
FIG. 4: is a ¾ bottom perspective elevation view of a rotary organizer for brushes in accordance with an embodiment of the present invention.

Turning now to FIG. 4, a ¾ bottom perspective elevation view illustration is shown. In this embodiment, the main body 1 of the rotary organizer is shown with the cup element 2 of the main body 1. The base element 4 is configured to hold the main 1 body firmly in place with a rubber suction cup 5. In a preferred embodiment the cup element 2 is configured to rotate upon the base element 4, as indicated by the rotational arrow 12. A lever 6, located at the bottom of the rotary organizer, secures and releases the suction cup 5 via a lever handle 7. Furthermore, a weighted element 11, disposed on a bottom side of the base element 4 provides stability during rotation of the cup element 2. In some embodiments, the weighted element 11 may be attached to the bottom side of the base element 4.

Figure 5:
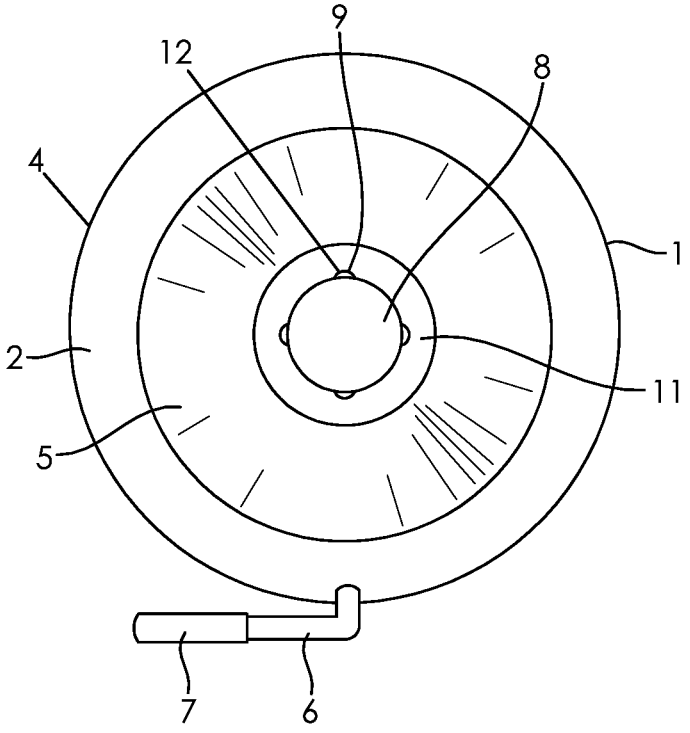
FIG. 5: is a bottom elevation view of a rotary organizer for brushes in accordance with an embodiment of the present invention.

Turning now to FIG. 5, a bottom elevation view illustration is shown. In this embodiment, the main body 1 of the rotary organizer is shown with the cup element 2 of the main body 1. A lever 6 secures and releases a suction cup at the bottom of the rotary organizer via operation of a lever handle 7. Further in this figure is shown a center hub 8 with a plurality of locking pegs 9 that allow the adjustment for the hub, via rotation, between a plurality of securable positions. In a preferred embodiment, the locking pegs 9 on the center hub 8 are configured to engage with the grooves 12 that are incorporated into the base element 4 and define each of the designated positions that make up the plurality of positions. Furthermore, a weighted element 11, disposed on a bottom side of the base element 4 provides stability during rotation of the cup element 2. In some embodiments, the weighted element 11 may be attached to the bottom side of the base element 4.

Figure 6:
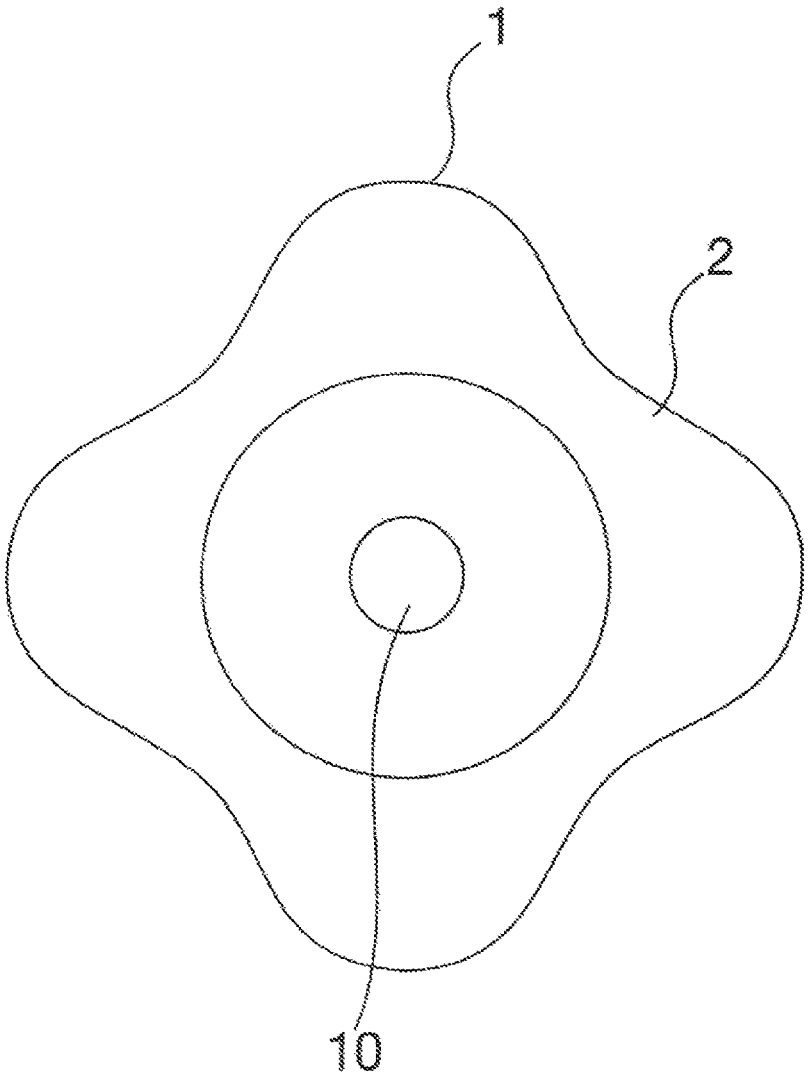
FIG. 6: is a top lid elevation view of a rotary organizer for brushes in accordance with an embodiment of the present invention.

Turning now to FIG. 6, a top lid elevation view illustration is shown. In this embodiment, the main body 1 of the rotary organizer is shown with the cup element 2 of the main body 1 with a center hub hole 10. Center hub hole 10 on the cup element 2 is configured to engage with the base element 4 in order to secure the cup element 2 to the base element 4 and allow for the rotational features described herein.

In accordance with a preferred embodiment of the present invention, the rotary organizer can be manufactured in a variety of heights, depending on the use of a particular rotary organizer. For instance, in one preferred embodiment of the present invention, a standard size rotary organizer may stand at 5 inches tall, comprise 4 grooves and can hold at least 4 "normal" size hairbrushes, and at least 9 taller make-up brushes, art and craft brushes, pencils, markers and pens. It can also come in 7 grooves.

In another preferred embodiment, a smaller size rotary organizer may stand at 3.5 inches tall, comprise 4 grooves and can hold at least 4 small hairbrushes, such as for infants and children, other infant care items such as thermometers, creams and ointments in tubes, and at least 9 shorter make-up brushes, small paint and craft brushes, pencils, markers and pens.

In another preferred embodiment, a larger size rotary organizer may stands at 6.5 inches tall and can hold larger hairbrushes and larger paint and craft brushes. This larger size rotary organizer may comprise, for instance, 7 grooves or 10 grooves. These embodiments are geared more for professional hair stylists or avid hair brush users.

While the above detailed descriptions reference three preferred embodiments of rotary organizer sizes, one of ordinary skill in the art would appreciate that other embodiments of rotary organizers may be constructed and utilized. The preferred embodiments are enumerated for descriptive purposes and are not intended to be limiting. One of ordinary skill in the art would appreciate that there are numerous sizes and numbers of grooves that could be utilized with embodiments of the present invention, and embodiments of the present invention are contemplated in any such size and groove number.

According to an embodiment of the present invention, material used for construction of the cup element may be, for instance, plastic or acrylic, or something of similar sorts. In other embodiments, construction materials for the cup element may include, but are not limited to, glass, crystal and ceramics or any combination thereof. One of ordinary skill in the art would appreciate that there are numerous materials from which the cup element could be constructed and embodiments of the present invention are contemplated for use with any appropriate construction material.

In a preferred embodiment of the present invention, an outside housing of the base element may be made of the same material as the cup element for congruency. In preferred embodiments of the present invention, a weighted element may be incorporated into the base element, such as a metal piece or plate inside the base element. This weighted element is configured to provide weight and stability to the base in order to ensure the cup and its contents do not tip over from being top heavy or due to the rotational forces caused during the swiveling process. In alternative embodiments, either in lieu of or in conjunction with the weighted element, the base element may incorporate a securing element, such as s suction cup element, magnetic element, or other element configured to aid or assist with the retention of the rotary organizer on a surface. One of ordinary skill in the art would appreciate that there are numerous types of securing elements that could be utilized with embodiments of the present invention, and embodiments of the present invention are contemplated for use with any appropriate securing elements.

According to an embodiment of the present invention, the net element may be made of silicone or similar material. The net element is comprised for flexibility and this flexibility allows for the net element to hold objects of various sizes while still providing security from movement. While preferred embodiments may comprise nets of silicone or similar materials, one of ordinary skill in the art would appreciate that there are numerous elements from which the net element could be made, and embodiments of the present invention are contemplated for use with net elements of any appropriate material.

It should be noted that the features illustrated in the drawings are not necessarily drawn to scale, and features of one embodiment may be employed with other embodiments as the skilled artisan would recognize, even if not explicitly stated herein. Descriptions of well-known components may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A rotary organizer for brushes, said rotary organizer comprising:

a cup element comprising a cavity formed from a walled surface, said cavity having therein a net element configured to retain a plurality of brushes thereupon; and a base element, connected to said cup element and forming a stable base upon which said cup element rotates to a plurality of positions, said base element further comprising a weighted element and a securing element, wherein each position of said plurality of positions is defined by a groove in said base element; and wherein a center hub extending from said base element enables said cup element to rotate relative to said base element and comprises a plurality of locking pegs configured to engage with said grooves to secure said cup element into one of said plurality of positions.

2. The rotary organizer for brushes of claim 1, wherein said weighted element is configured to provide stability to the base and prevent the rotary organizer from tipping over when brushes are inserted or removed from said net element.

3. The rotary organizer for brushes of claim 1, wherein said securing element is configured to secure said base element to a surface.

4. The rotary organizer for brushes of claim 3, wherein said securing element is a suction cup.

5. The rotary organizer for brushes of claim 4, wherein said base element further comprises a lever and handle element configured to interact with said suction cup in order to allow for the release of said suction cup from said surface.

6. The rotary organizer for brushes of claim 1, wherein the net element is formed on an inner wall of said cup element.

7. The rotary organizer for brushes of claim 6, wherein the net element comprises a plurality of brush retention grooves, each brush retention groove being configured to retain a brush therein.

8. The rotary organizer for brushes of claim 1, wherein the cup element and base element are connected via engagement between the center hub and a center hub hole.

9. A rotary organizer for brushes, said rotary organizer comprising:

a cup element comprising a cavity formed from a walled surface, said cavity having therein a net element configured to retain a plurality of brushes thereupon; and a base element, connected to said cup element and forming a stable base upon which said cup element rotates to a plurality of positions, and wherein said base element further comprises a weighted element and a securing element, said weighted element configured to provide stability to the base and prevent the rotary organizer from tipping over when brushes are inserted or removed from said net element;

said securing element configured to secure said base element to a surface;

wherein each position of said plurality of positions is defined by a groove in said base element; and wherein a center hub extending from said base element enables said cup element to rotate relative to said base element and comprises a plurality of locking pegs that engage with said grooves to secure said cup element into one of said plurality of positions; and wherein the cup element and base element are connected via engagement between a center hub hole.

10. The rotary organizer for brushes of claim 9, wherein said securing element is a suction cup.

11. The rotary organizer for brushes of claim 10, wherein said base element further comprises a lever and handle element configured to interact with said suction cup in order to allow for the release of said suction cup from said surface.

12. The rotary organizer for brushes of claim 9, wherein the net element is formed on an inner wall of said cup element.

13. The rotary organizer for brushes of claim 12, wherein the net element comprises a plurality of brush retention grooves, each brush retention groove being configured to retain a brush therein.

* * * * *